United States Patent [19]

Freeman

[11] 4,389,554

[45] Jun. 21, 1983

[54] TRANSFORMER PROTECTIVE SWITCH

[75] Inventor: Willie B. Freeman, Irwin, Pa.

[73] Assignee: Westinghouse Electric Corp., Pittsburgh, Pa.

[21] Appl. No.: 163,131

[22] Filed: Jun. 26, 1980

[51] Int. Cl.[3] ..... H01H 33/88

[52] U.S. Cl. ..... 200/148 A; 200/82 B; 200/148 R

[58] Field of Search ..... 200/148 A, 82 B, 148 R

[56] References Cited

U.S. PATENT DOCUMENTS 2,258,376 10/1941 Clothier et al. ..... 200/82 B 3,946,180 3/1976 Votta et al. ..... 200/148 A 4,251,701 2/1981 Meyer ..... 200/82 B

*Primary Examiner*—Robert S. Macon

*Attorney, Agent, or Firm*—M. S. Yatsko

[57] ABSTRACT

An electric switch includes a pair of separable contacts operable between open and closed positions with respect to each other. An operator shaft is utilized for moving one of the contacts, and the operator shaft has attached thereto at the opposite end an operator piston which is disposed within an operator cylinder. A chemical operator is utilized for generating a hot gas within the operator cylinder and against the operator piston to cause movement thereof.

7 Claims, 2 Drawing Figures

CLOSED POSITION

OPEN POSITION

TRANSFORMER PROTECTIVE SWITCH

BACKGROUND OF THE INVENTION

This invention relates generally to electric switches, and more particularly to a circuit interrupting device which utilizes a chemical operator for providing the motive force for separating the contacts during opening.

Electric utilities, in their attempt to minimize expenses so as to be able to supply electricity at the lowest possible cost, specify and use equipment which closely matches the performance characteristics required at the particular locations. As a result, utilities are reluctant to purchase equipment whose performance characteristics exceed those required if lower-performing equipment still meeting the requirements is available. For example, at certain voltage levels of, say 69 KV, a utility may use a power fuse to provide transformer protection for substation transformers because such fuses provide adequate interrupting capability. However, at 138 KV, such power fuses are no longer utilized since they lack sufficient interrupting capability. However, at such voltage levels as 138 KV, a normally obtainable power circuit breaker, although having adequate interrupting capabilities to provide the required protection, has performance characteristics which greatly exceed those required to provide adequate transformer protection. Therefore, manufacturers are constantly striving to build circuit interrupting devices which meet the needs of the electric utility industry, but which do not substantially exceed such requirements so as to be able to supply such circuit interrupters at the lowest possible cost.

SUMMARY OF THE INVENTION

In accordance with this invention, an electric switch is described which comprises stationary and movable contacts operable between open and closed positions with respect to each other, and means for producing a flow of insulating gas between the stationary and movable contacts during opening. Means are provided for moving the movable contact which include an operator shaft directly coupled to the movable contact and having a piston at the other end. An operator cylinder has disposed therein the piston, and a chemical operator extends into the operator cylinder longitudinally intermediate the piston and the movable contact. The chemical operator, upon activation, ignites and generates a hot gas within the operator cylinder against the piston to cause movement thereof, resulting in movement of the movable contact through the operator shaft. Means are included for activating the chemical operator.

BRIEF DESCRIPTION OF THE DRAWINGS

Reference is now made to the description of the preferred embodiment illustrated in the accompanying drawings, in which.

DESCRIPTION OF THE PREFERRED EMBODIMENT

Figure 1:
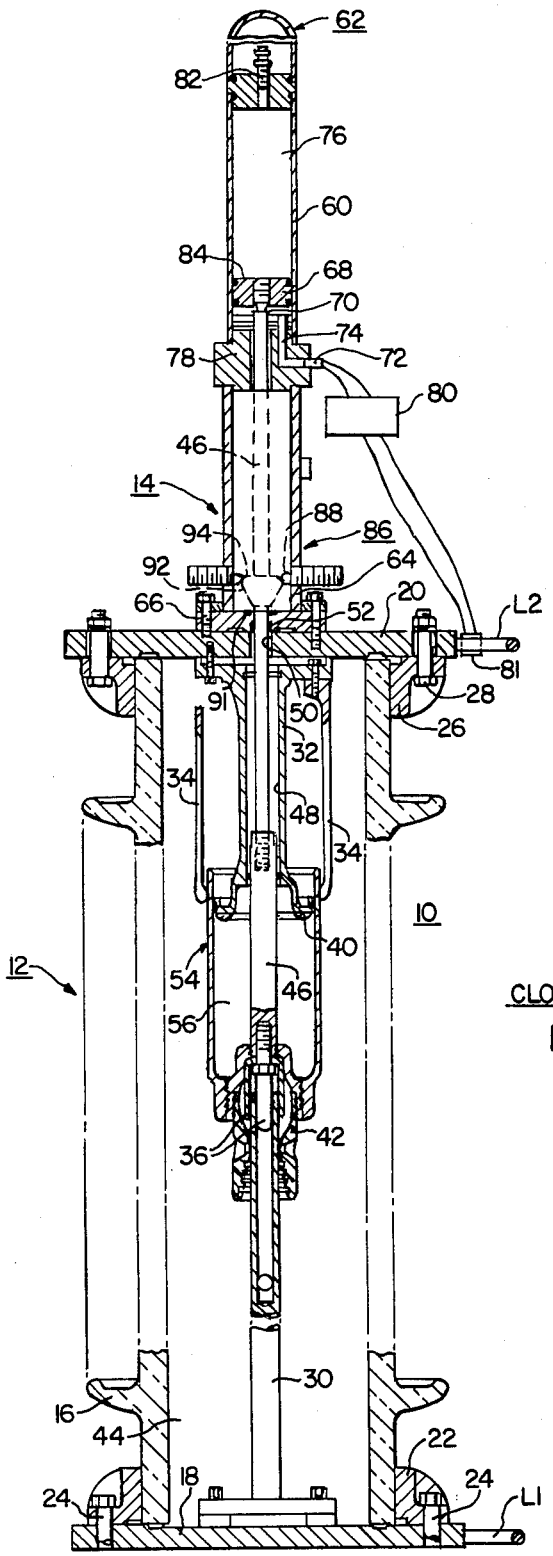
FIG. 1 is an illustration, partially in section, of the switch of this invention with the contacts in the closed position.

Referring now more particularly to FIG. 1, therein is illustrated the electric switch or circuit interrupter 10 according to the teachings of this invention. The switch

10 is particularly useful to provide protection of subtransmission-class transformers, and is comprised of an interrupter assembly 12 and an operator assembly 14. The interrupter assembly 10 is comprised of a hollow, insulating housing 16 having secured thereto at the ends first and second end plates 18, 20. The insulating housing 16 is secured to the end plate 18 by means of the clamp ring 22 which, in turn, is bolted by means of bolts 24 to the end plate 18. In a similar fashion, the housing 16 is secured to end plate 20 by means of the clamp ring 26 which, again, is bolted to the end plate 20 by means of the bolts 28. The end plate 18 would, for example, be connected to a power line L1, and the end plate 20 would be electrically connected to the power line L2.

Disposed within the interior of the housing 16, and secured to the end plate 18, is the stationary contact 30. Likewise disposed within the interior of the housing 16, and secured to end plate 20, is the stationary puffer piston 32 which is surrounded by a plurality of stationary finger contacts 34. The stationary contact 30 is in electrical contact with line L1 through the end plate 18, and the finger contacts 34 are in electrical contact with the power line L2 through end plate 20.

A movable contact 36 is disposed within the housing 16, and is fixedly secured, both mechanically and electrically, to a puffer cylinder 38 which cylinder 38 is sized so as to nest snugly over the expanded portion 40 of the stationary puffer piston 32, with the finger contacts 34 contacting the exterior 54 of the puffer cylinder 38. Also secured to the puffer cylinder 38, and movable therewith, is an insulating nozzle 42. The interior of the housing 16 would be filled with an insulating gas 44 typical of which is sulfur hexafluoride at a pressure of 75 pounds psi gauge.

Secured to the puffer cylinder 38 and capable of causing movement of the puffer cylinder 38 and the movable contact 36 and insulating nozzle 42 secured thereto, is the operator shaft 46. The operator shaft 46 extends through the hollow bore 48 in the stationary puffer piston 32 and likewise extends through the opening 50 in end plate 20 to the operator assembly 14. Sealing means 52 are disposed adjacent the operator shaft 46 and the end plate 20 to prevent the insulating gas 44 from flowing outside the interior of the housing 16 into the operator section 14. The operator shaft 46 functions to move the movable contact 36 between the closed position illustrated in FIG. 1 and the open-circuit position illustrated in FIG. 2.

Figure 2:
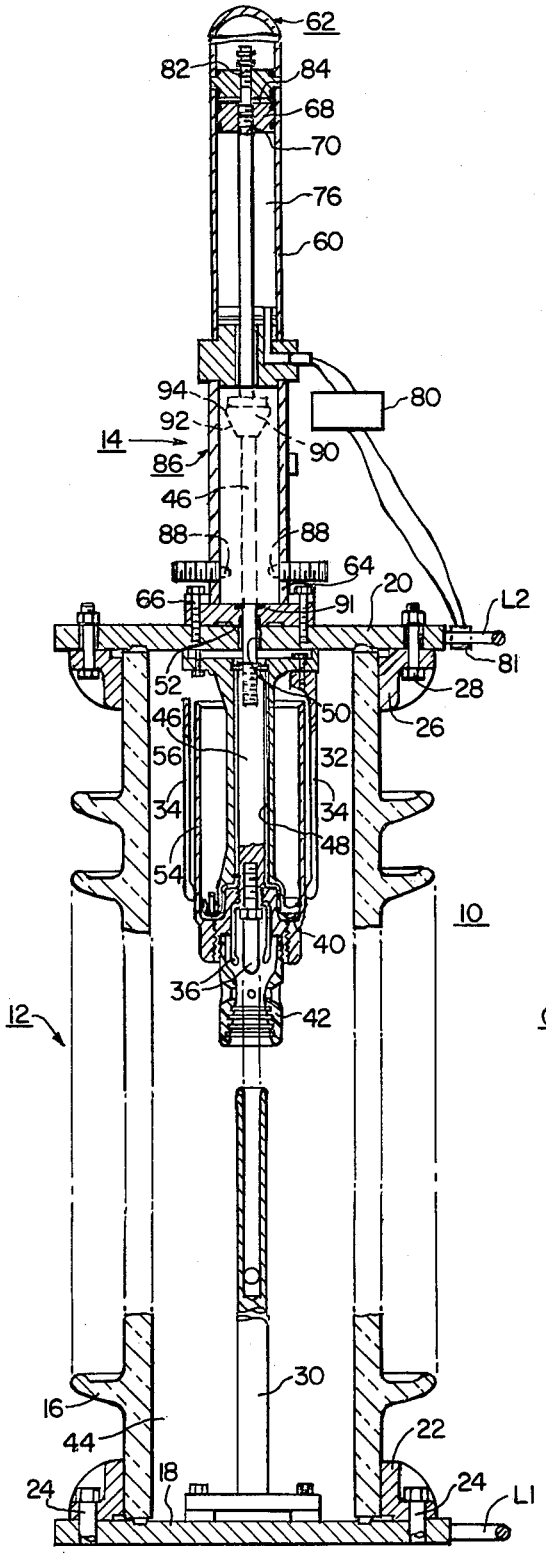
FIG. 2 is an illustration of the switch with the contacts in the open-circuit position.

The operation of the circuit-interrupter assembly 12 can best be understood with reference to both FIGS. 1 and 2. In FIG. 1, the stationary and movable contacts 30, 36, respectively, are in their closed position, and the circuit extends from line L1, through the end plate 18, the stationary contact 30, the movable contact 36, the puffer cylinder 38, the finger contacts 34 which are in contact with the exterior surface 54 of the puffer cylinder 38, through the end plate 20 to line L2. During the opening operation, the operator assembly 14 causes a movement of the operator shaft 46 (to the top as shown in the figures), which causes a corresponding movement of the puffer cylinder 38, the insulating nozzle 42, and the movable contact 36 away from the stationary contact 30. As this movement progresses, the movement of the puffer cylinder 38 over the stationary puffer piston 32 causes a compression of the insulating gas 44 present within the area 56 between the puffer cylinder 38 and the extended portion 40 of the puffer piston 32.

As this gas is compressed, it flows outwardly past the movable contact 36 and is directed by the insulating nozzle 42 into the arc established between the parting stationary and movable contacts 30, 36. This insulating gas compressed by the relative movement of the puffer cylinder 38 over the puffer piston 32 causes the arc drawn between the stationary and movable contacts 30, 36 to be extinguished, thereby interrupting the circuit between line L1 and line L2. The insulating gas 44 present within the housing 16 has sufficient dielectric strength to maintain the electrical isolation of line L1 from line L2.

As can be seen from the above description, the operator shaft 46 is utilized for moving the movable contact 36 into and out of engagement with the stationary contact 30 to close or open the circuit, respectively, between lines L1 and L2. The operator assembly 14 of the switch 10 is utilized for moving this operator shaft 46.

The operator assembly 14 is comprised of an operator cylinder 60 which is closed by an end cap 62 at one end thereof, with the other end 64 of the operator cylinder 60 being secured, by means such as bolts 66, to end plate 20. The operator cylinder 60 is disposed on end plate 20 so that the opening 50 in end plate 20 is aligned with the interior of the operator cylinder 60. The operator shaft 46 which extends through opening 50 in end plate 20 extends into the interior of the operator cylinder 60, and has an operator piston 68 secured to the end 70 thereof. A chemical operator 72 extends into the interior of the operator cylinder 60 and is longitudinally disposed intermediate the operator piston 68 and the movable contact 36. The chemical operator 72 communicates through the gas communication path 74 with the area 76 inside the operator cylinder 60 between the operator piston 68 and the gas block 78. The chemical operator is a gas generator containing a chemical propellant, and, upon activation, ignites and generates a hot gas at a pressure of several hundred pounds psi gauge in the area 76 within the operator cylinder 60. The hot gases generated by the chemical operator 72 rapidly expand, and drive the operator piston 68 through the opening stroke to the position shown in FIG. 2. Because the operator piston 68 is connected to the operator shaft 46 and thence to the movable contact 36, this rapid movement of the operator piston 68 causes a corresponding movement of the movable contacts 36 to the open position shown in FIG. 2. During this movement, the interrupter assembly 12 functions as has heretofore been described.

The chemical operator 72 is electrically connected to an activation device 80 which, in turn for example, would be electrically coupled to the power line L2, as schematically illustrated by block 81. Thus, upon the occurrence of an abnormal condition in line L2, the abnormality would be sensed by device 81, which would send an electrical signal to the activation device 80 which, upon the occurrence of certain preset conditions, would in turn provide an electrical signal to the chemical operator 72 to cause activation thereof.

To move the movable contact 36 into closed position with the stationary contact 30, a low pressure air fitting 82 is utilized to insert air against the back side 84 of the operator piston 68, with this air pressure forcing the operator piston 68, and the operator shaft 46 and movable contacts 36 connected thereto, towards the bottom as illustrated in the drawings into the closed position in contact with the stationary contact 30. During this closing operation, latching means 86 are utilized for latching the movable contact 36 in the closed position.

The latching means 86 comprise a pair of spring-biased detente latches 88 which extend into the operator cylinder 60, and a truncated conical latch member 90 which is fixedly secured to the operator shaft 46. As the operator shaft 46 moves the movable contact 36 into the closed position, the detente latches 88 travel upon the tapering portion 92 of the latch member 90 and, when the movable contacts 36 are in their fully closed position, the detente latches 88 are released against the back side 94 of the latch member, thus holding the operator shaft 46 in its closed position. Additional sealing is provided by the latch member 90, which bears against a gasket 91 when latched in the closed position. Because the detente latches 88 are biased by low spring forces, they are insufficient to hold the operator shaft 46, through the latch member 90, in position when the significantly greater forces exerted by the expanding hot gases from the chemical operator 72 are generated.

Thus, as can be seen, what has been described is an electric switch or gas-insulated circuit interrupter which utilizes a chemical operator to provide the driving force to cause separation of stationary and movable contacts. Although the switch is particularly useful for providing protection for subtransmission-class transformers, the switch is likewise applicable and useful in a variety of circuit-protection locations.

I claim as my invention:

1. An electric switch comprising:

a stationary contact;

a movable contact operable between open and closed positions with respect to said stationary contact;

means for moving said movable contact during an opening operation comprising:

an operator shaft directly coupled at one end to said movable contact and having a piston at the other end thereof;

an operator cylinder having disposed therein said piston;

a chemical operator extending into said operator cylinder and being longitudinally disposed intermediate said piston and said movable contact, said chemical operator, upon activation, igniting and generating a hot gas within said operator cylinder and against said piston to cause movement thereof, movement of said piston causing movement of said movable contact through said operator shaft; and means for activating said chemical operator; and means for inserting pressurized air against said piston distal from said movable contact to move said piston, and said movable contact through said operator shaft, during a closing operation.

2. A gas-insulated electric switch comprising:

a hollow insulating housing having first and second end plates and containing an insulating gas;

a stationary contact disposed in said housing and secured to said first end plate;

a movable contact operable between open and closed positions with respect to said stationary contact disposed within said housing and electrically connected to said second end plate;

means for producing a flow of insulating gas between said stationary and movable contacts during an opening operation;

means for moving said movable contact during an opening operation comprising:

an operator cylinder secured to said second end plate externally to said housing, said second end plate having an opening therethrough aligned with said operator cylinder;

an operator shaft directly coupled at one end to said movable contact and extending through said second end plate opening to within said operator cylinder, said operator shaft having a piston at the other end thereof disposed within said operator cylinder;

sealing means disposed adjacent said operator shaft and said second end plate for preventing gas from flowing from said housing into said operator cylinder;

a chemical operator extending into said operator cylinder intermediate said piston and said second end plate, said chemical operator, upon activation, igniting and generating a hot gas within said operator cylinder and against said piston to cause movement of said piston and said operator shaft; and means for activating said chemical operator; and means for inserting pressurized air into said operator cylinder against said piston distal from said movable contact to move said piston, and the movable contact coupled thereto, during a closing operation.

3. The switch according to claims 1 or 2 including means for latching said movable contact in said closed position.

4. The switch according to claim 3 wherein said latching means comprises a pair of spring-biased detente latches extending into said operator cylinder and a conical latch member fixedly secured to said operator shaft, said detente latches, upon a closing operation, traveling upon said conical latch member and being released upon said movable contact reaching said closed position.

5. The switch according to claim 2 wherein said flow producing means comprises a puffer piston structure fixedly secured to said second end plate within said housing and a movable puffer cylinder fixedly secured to said movable contact and movable therewith, said puffer cylinder movable over said puffer piston to compress gas therebetween, said gas compressed flowing past said movable contact.

6. A compressed-gas insulated switch comprising:

a pair of separable contacts;

means for causing the separation of said separable contacts to establish an arc therebetween comprising an operator shaft directly connected to one of said separable contacts, a piston connected to said operator shaft, a closed operator cylinder having disposed therein said piston, a chemical operator extending into said operator cylinder, said chemical operator upon activation igniting and generating a hot gas within said operator cylinder and against said piston to cause movement thereof, and means for activating said chemical operator;

means forcing a blast of compressed gas against said established arc to effect extinction thereof; and means for inserting pressurized air into said operator cylinder against said piston distal from said chemical operator to move said piston, and the contact connected thereto, during a closing operation.

7. The switch according to claim 6 wherein the source of compressed gas is obtained by relative movement of a movable puffer cylinder, secured to said one separable contact, slidable over a relatively stationary puffer piston structure.

* * * * *